US007891018B2

(12) United States Patent
Atkinson

(10) Patent No.: US 7,891,018 B2
(45) Date of Patent: Feb. 22, 2011

(54) KNEE PROTECTIVE DEVICE

(76) Inventor: Tammany Atkinson, 1154 Burrowhill Lane, Mississauga, Ontario (CA) L5H 4M7

( * ) Notice: Subject to any disclaimer, the term of this patent is extended or adjusted under 35 U.S.C. 154(b) by 0 days.

(21) Appl. No.: 11/209,728

(22) Filed: Aug. 24, 2005

(65) Prior Publication Data

US 2007/0044195 A1 Mar. 1, 2007

(51) Int. Cl.
*A41D 13/00* (2006.01)

(52) U.S. Cl. ..... 2/24

(58) Field of Classification Search ..... 2/22, 2/23, 24, 455, 16, 62, 911; 128/881, 882; 602/5, 16, 20, 23, 26, 62
See application file for complete search history.

(56) References Cited

U.S. PATENT DOCUMENTS 4,561,124 A 12/1985 Thompson
4,831,666 A * 5/1989 Denman ..... 2/23
4,920,577 A * 5/1990 Scharf ..... 2/24
5,105,473 A * 4/1992 Valtakari ..... 2/461
5,134,726 A * 8/1992 Ross ..... 2/465
D338,281 S 8/1993 Bottorff et al.
5,611,081 A 3/1997 Torres
5,729,832 A * 3/1998 Grilliot et al. ..... 2/23
5,845,333 A * 12/1998 Crampton ..... 2/24
6,115,838 A * 9/2000 Scholtis et al. ..... 2/46
6,332,224 B1 12/2001 Walker et al.
6,805,957 B1 * 10/2004 Santos et al. ..... 428/400
7,089,598 B2 * 8/2006 Sallas et al. ..... 2/79

* cited by examiner

*Primary Examiner*—Tejash Patel

(57) ABSTRACT

A knee protective device for garments comprising of at least one pocket in the vicinity of the knees having an opening for receiving an insert for protecting the wearer's knees.

3 Claims, 5 Drawing Sheets

KNEE PROTECTIVE DEVICE

FIELD OF INVENTION

This invention relates generally to knee protectors and particularly relates to knee protective devices that are incorporated into clothing items or garments for infants. This invention further relates to knee protective devices that are incorporated in the vicinity of the knee portion of shorts, pants or socks for protecting knees.

BACKGROUND ART

Knee protectors or knee protective devices are well known in the prior art and have been utilized in different contexts.

For example, tradesmen such as electricians, floor tilers, construction workers often use knee pads or knee protectors when they are engaged in activities which require kneeling for extended periods of time. Without the knee protection the kneeling can result in much discomfort and even injury.

U.S. Pat. No. 5,611,081 relates to work pants with knee and shin protectors, whereby the protectors are padding which is provided to protect both the knees and the shins of the worker. The protective padding for the knees is received by a pocket in the work pants that is separate from the pocket which receives the shin protective padding.

Another type of knee padding for work pants is shown in U.S. Pat. No. 4,561,124. This knee protector is inserted into a pocket in the legs of work pants and is a V-shaped cross-sectional configuration for improved appearance. The pocket is stitched to the pant leg.

Knee pads or knee protectors are also required for infants to prevent injuries and protect infant's knees when they are crawling. Crawling is known to cause scratches, bruises, chafed knees, and even rug or floor burns on infant's knees. Accordingly, various types of knee pads or protectors have been developed for infants and children over the years. Knee protectors or knee protective devices will protect infant and children's knees from injury from crawling or from falls or slips. It has been recognized that protecting infant's knees while crawling is essential for timely development of normal postural strength in the spine of the infant.

U.S. Pat. No. 6,332,224 relates to a pair of long socks or sock bands which incorporate knee pads into the socks or sock pads to protect an infant's knees when crawling. Another example of an infant knee pad is shown in U.S. Design Pat. No. 338,281.

It is an object of this invention to provide an improved knee protective device.

It is a further object of this invention to provide a garment which incorporates an improved knee protective device for protecting the knees of the wearer.

It is a further object of this invention to provide for a knee protective device which is flexible, durable and compression resistant.

DISCLOSURE OF INVENTION

It is an aspect of this invention to provide a knee protective device for garments comprising of at least one pocket in the vicinity of the knee portion of the garment, said pocket having an opening for receiving an insert for providing protection to the wearer's knees.

BEST MODE FOR CARRYING OUT THE INVENTION

Figure 1:
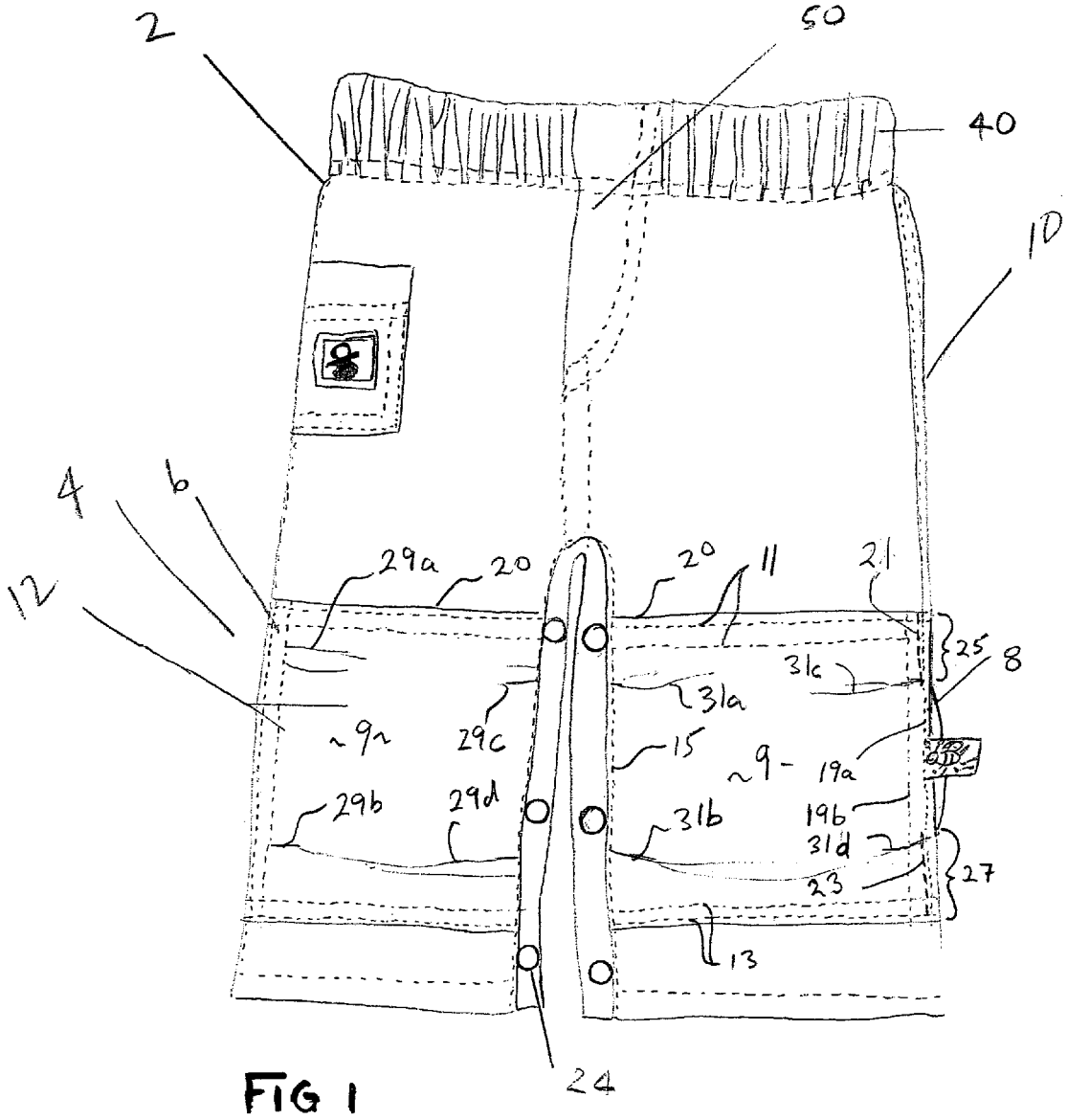
FIG. 1 is a front view of a garment incorporating the knee protective device.

In the description that follows, like parts are marked throughout the specification and drawings with the same respective reference numerals. The drawings are not necessarily to scale and in some instance proportions may have been exaggerated in order to more clearly depict certain features of the invention.

Figure 2:
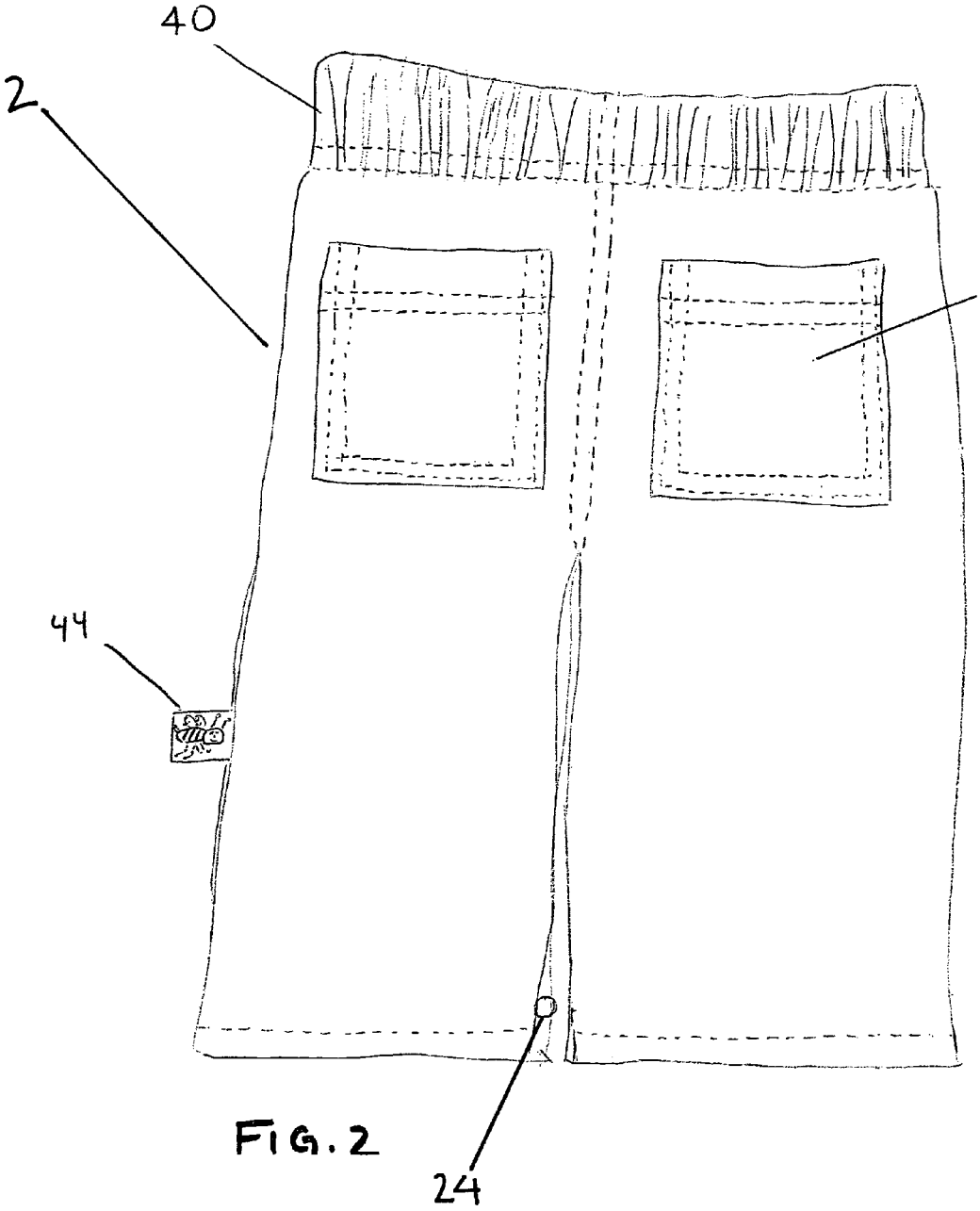
FIG. 2 is a rear view of a garment.

FIG. 1 is a front view of a garment 2, namely pants for infants, incorporating a knee protective device 4 in the vicinity of the knee region 12. Alternatively, the garment 2 could either be long shorts, a jumper, overalls, long socks, or any other garment which covers the wearer's knees. FIG. 2 is a rear view of a garment 2.

The knee protective device 4 as shown in FIG. 1 is comprised of at least one pocket or enclosure 6 which has an opening 8 in the vicinity of the knee region 12. Preferably, the knee protective device 4 will have two pockets 6, one for each knee of the garment 2. The pocket 6 covers the knee region 12 of the garment 2. The pocket 6 is of a material which may be the same or different than the material of the garment 2. The garment comprises of a cloth material generally used, such as for example wool, polyester, or blends commonly used. For aesthetic purposes, the pocket 6 may also be of a different colour than the garment 2.

Preferably, each pocket 6 is the full width of each respective leg portion 10 of the garment 2. The pocket 6 is stitched or sewn on to the garment 2 in the knee region 12. The pocket 6 in one embodiment can consist of an extra piece of fabric 9 sewn or stitched on front of the pant legs 10 in the vicinity of the knee area. In other words, the pocket 6 is fully stitched on all sides except for one side which is the opening 8. More particularly, the pocket 6 consists of a piece of material 9 stitched at the top 11, bottom 13 and one side 15 as shown. The edge 17 is folded over and stitched at 19*a* and 19*b* to produce a clean opening 8. The opening 8 is preferably on the outermost side 14 of the garment 2 which is down the length of the garment 2; however alternatively the opening 8 may be on another side of the pocket 6 on the top. By having the opening 8 of the pocket 6 on the side 14 and stitched on the top, the stitched top will prevent the insert from being pushed out during crawling since the opening 8 is on the side 14.

The opening 8 is partially sewn shut in the vicinity of stitches 11 and 13. More specifically the edge 17 can include stitches 21 and 23 at the upper edge 25 and lower edge 27 of the edge 17 so that the sewn edges 25 and 27 trap the knee pad 16 to be described below.

Furthermore, the pocket material 9 includes pleats or folds 29*a*, 29*b*, 29*c*, 29*d*, and 31*a*, 31*b*, 31*c*, 31*d*, to provide a pocket 6 that can be puffed out relative the pant leg so as to accommodate the knee pad 16. In other words, the fabric 9 can be moved away from the front of the pant legs 10 to produce a bigger cavity to receive the knee pad 16.

Figure 3:
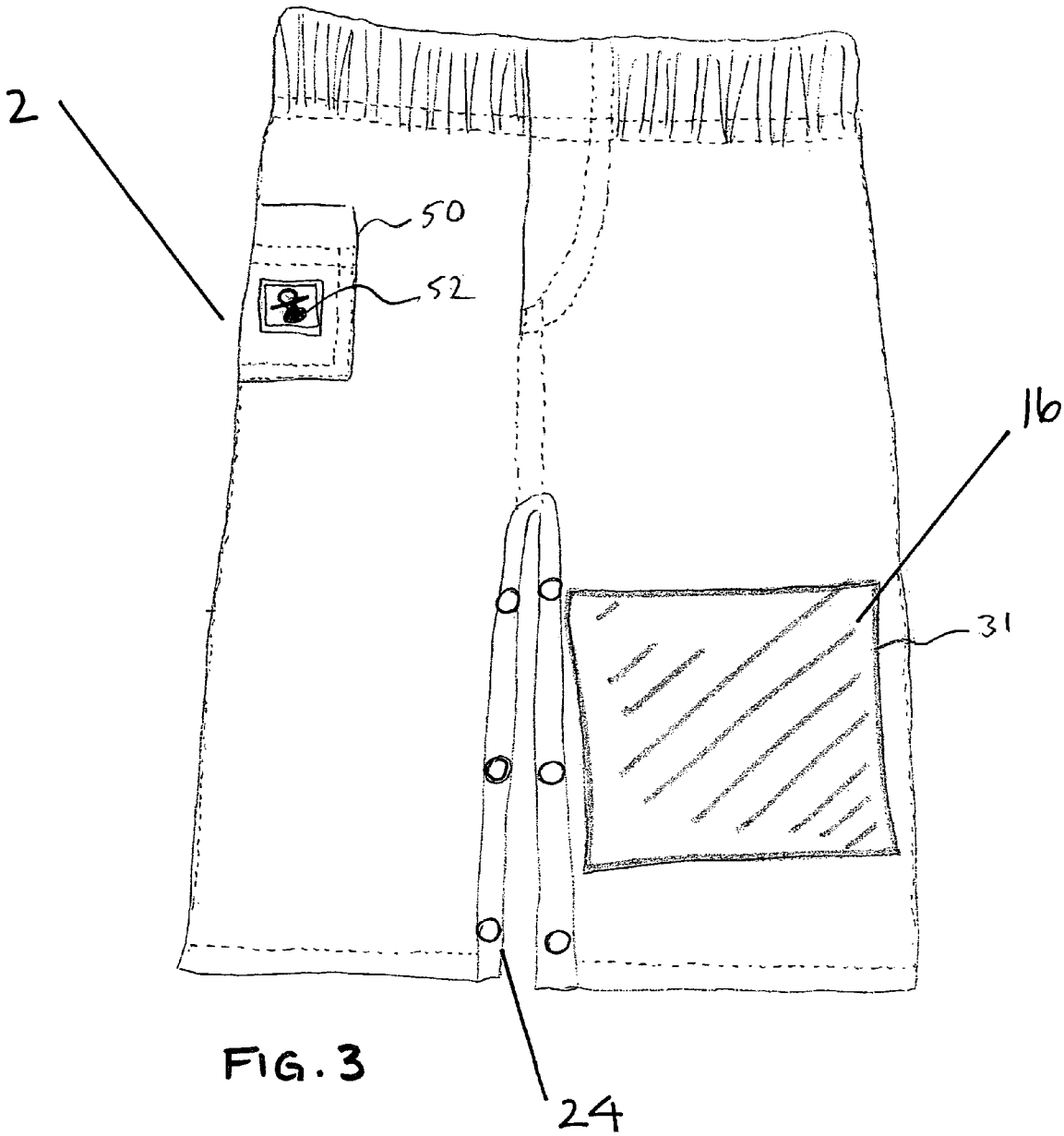
FIG. 3 is a front view of a garment incorporating the knee protective device showing the inner layer revealed.

The opening 8 receives an insert or knee pad 16. The insert 16 as shown in FIG. 3 is preferably comprised of a durable, cushiony, stretchable and compression resistant material which will provide the infant with comfort, support and cushion to protect the knees while crawling. Preferably, the insert

16 is made of neoprene or material with similar characteristics which provide compression resistance and shock absorption to the wearer while crawling or falling. In one embodiment, the neoprene pad has at least two (2) layers of material, one layer being rubber and the other being of nylon. The neoprene pad may however have one, two or more layers. The insert or knee pad 16 is generally the same size or slightly smaller than the pocket 6. Furthermore, the edge 31 of the knee pad 16 adjacent the opening 8 is larger than the opening 8 so that the edge 31 of the knee pad 16 will be caught, captured or trapped by stitches 21 and 23 to secure the knee pad 16 in place. Also, the knee pad 16 is flexible and can be collapsed to fit into the opening 8 of pocket 6. Upon release, the knee pad 16 will assume the volume or cavity of pocket 6. The pleats 29 and 31 will permit accommodation of the knee pad 16 in pocket 6.

The insert 16 is inserted into the opening 8 of the pocket 6 of each leg portion 10 of the garment 2. The insert 16 protects the knees of the wearer when crawling due to the characteristics of the material. The insert 16 is removable, and should be removed prior to washing the garment 2 so that the insert 16 can be re-used and lasts a long time for future use.

Figure 5:
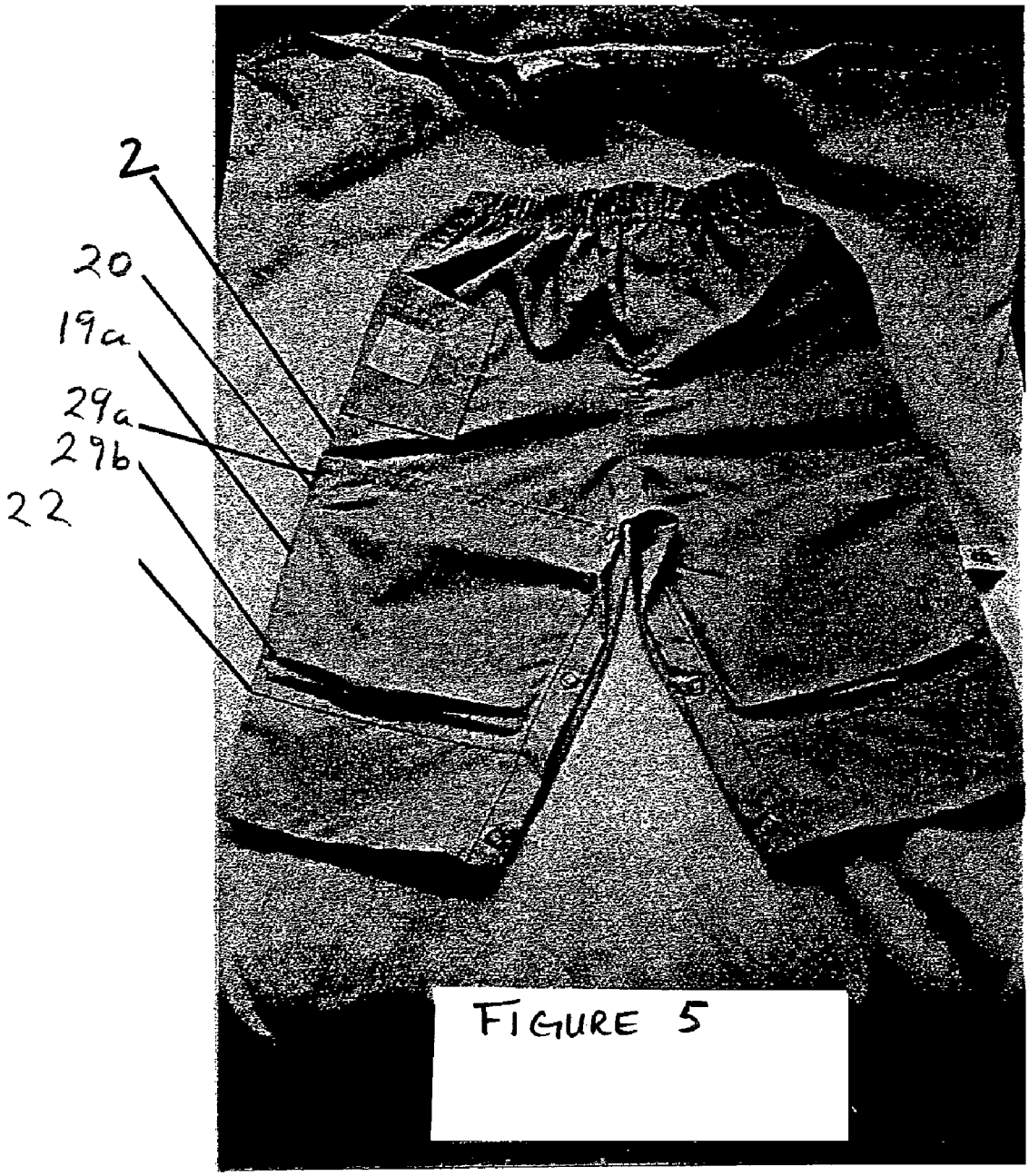
FIG. 5 is another front view of a garment having a knee protective device.

FIG. 5 shows the pleats 29*a*, 29*c*, 31*a* and 31*c* at the top side 20, pleats 29*b*, 29*d*, 31*b* and 31*d* at the bottom side 22 of the pocket 6. The folds and bottom of the pocket allow for extra material which allows extra room for bending the knees, and making the garment 2 more comfortable for the wearer.

FIG. 2 shows the rear view of the garment 2, which can have an elastic waist band 40, rear pockets 42, logo 44. Snaps 24 can be included for opening the entire side of the leg 10 for infants in a manner well known to people skilled in the art.

FIG. 3 is a front view of a garment incorporating the knee protective device showing the insert 16 revealed, and soother pocket 50 and indicia 52 showing a soother.

Figure 4:
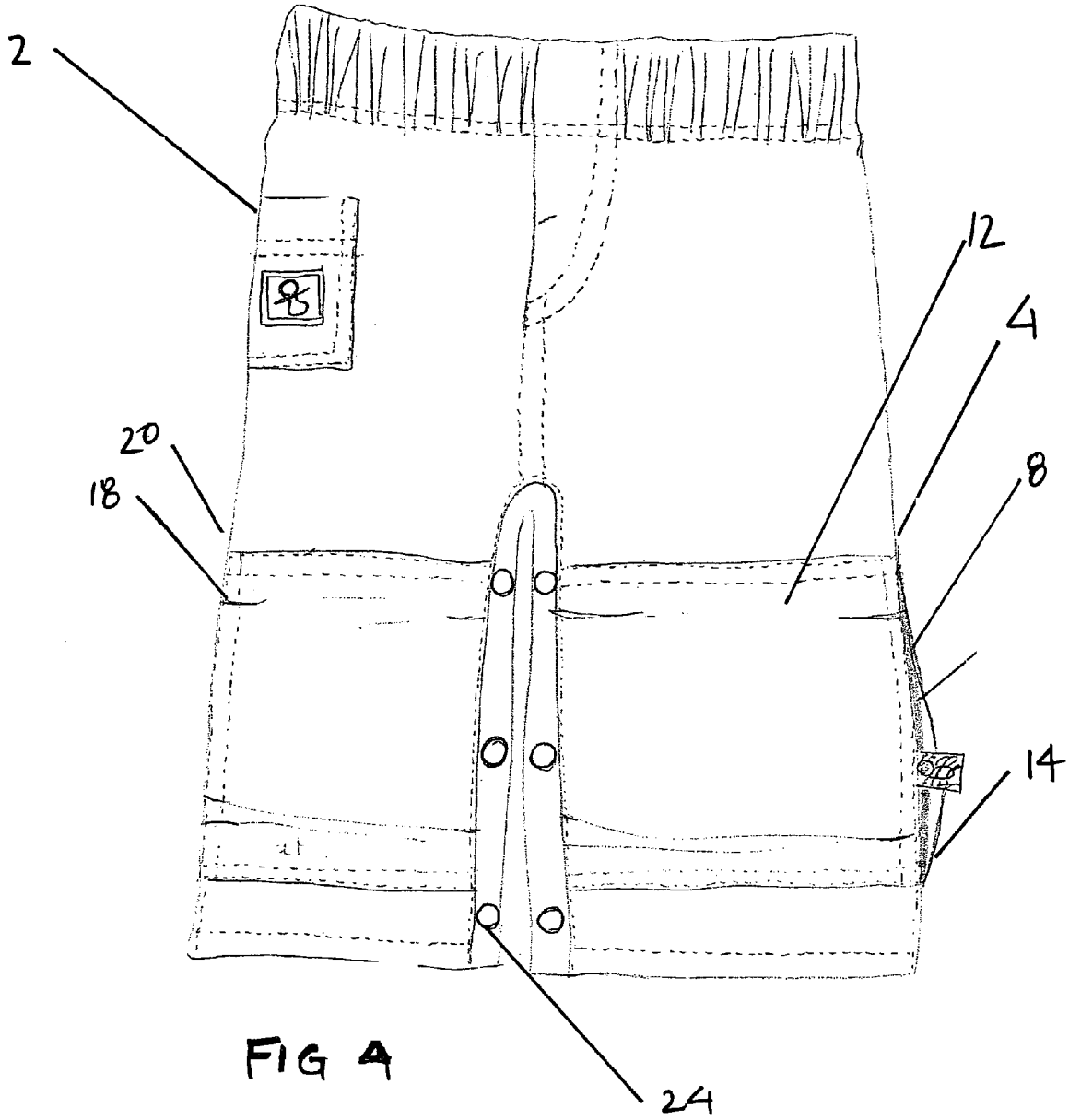
FIG. 4 is another front view of a garment incorporating the knee protective device.

FIG. 4 is another front view of a garment incorporating the knee protective device 4, where the opening 8 opens at the side of the legs between the pleats 29*a* and 29*b* and 31*c* and 31*d* to allow the knee pad 16 to slide in.

FIG. 5 is another front view of a garment having a knee protective device.

The snaps 24 shown in FIG. 1 are particularly useful for young children. However, for older toddlers, the snaps may be dispensed with and the legs 10 stitched.

Moreover, children who are active will tend to wear the knee areas of their garments. Accordingly, the invention described herein reinforces the knee area with the following layers:

(a) the original pant leg fabric 10

(b) neoprene or other material for the knee pad 16

(c) pocket material 9 to make a longer lasting garment. Also, these layers of material soften the impact of the user's knees against bumps and bruises.

The invention is particularly useful for young children who crawl on the floor as the opening is disposed on the lateral side of the pocket and the top 20 of the pocket 6 retains the pad. However, the invention can be used by adults when kneeling during gardening or other function requiring kneeling.

Various embodiments of this invention have now been described in detail. Since changes in and/or additions to the above-described best mode may be made without departure from the nature, spirit or scope of the invention, the invention is not to be limited to said details.

I claim:

1. A garment for an infant comprising: infants pants with: two longitudinally extending leg portions, a pair of pockets sewn substantially about a knee portion of each one of said leg portions, each one of said pair of pockets having an upper, lower, and two lateral sides and at least one transverse pleat with;

an opening extending through one of said two lateral sides while the upper, lower and other one of the two lateral sides are stitched; and an impact absorbing insert is removeably insertable in each one of said pair of pockets through said opening;

wherein said at least one transverse pleat provides a substantially expandable cavity in each one of said pair of pockets to accommodate said insert; the opening is smaller than a lateral edge of the impact absorbing insert positioned within the infant pants.

2. A garment as claimed in claim 1 wherein said pocket is disposed about an outside surface of one of said leg portions.

3. A garment as claimed in claim 2 wherein said impact absorbing insert comprises neoprene.

* * * * *